US008220773B2

(12) United States Patent
Gustafson

(10) Patent No.: US 8,220,773 B2
(45) Date of Patent: Jul. 17, 2012

(54) RECHARGEABLE SUBSEA FORCE GENERATING DEVICE AND METHOD

(75) Inventor: Ryan Gustafson, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 764 days.

(21) Appl. No.: 12/338,669

(22) Filed: Dec. 18, 2008

(65) Prior Publication Data

US 2010/0155072 A1 Jun. 24, 2010

(51) Int. Cl.
*E21B 33/06* (2006.01)

(52) U.S. Cl. ..... 251/1.1; 166/364

(58) Field of Classification Search ..... 251/1.1–1.3; 166/364, 85.4; 91/508, 510; 92/129
See application file for complete search history.

(56) References Cited

U.S. PATENT DOCUMENTS

| | | | | |
|---|---|---|---|---|
| 3,163,985 | A | 1/1965 | Bouyoucos | |
| 3,436,914 | A | 4/1969 | Rosfelder | |
| 3,595,012 | A * | 7/1971 | Beck, Jr. | 60/398 |
| 3,921,500 | A | 11/1975 | Silcox | |
| 3,987,708 | A * | 10/1976 | Uhrich | 92/134 |
| 4,076,208 | A * | 2/1978 | Olson | 251/1.3 |
| 4,095,421 | A | 6/1978 | Silcox | |
| 4,205,594 | A | 6/1980 | Burke | |
| 4,614,148 | A * | 9/1986 | Bates | 91/420 |
| 4,864,914 | A * | 9/1989 | LeMoine | 91/29 |
| 5,357,999 | A | 10/1994 | Loth | |
| 5,655,745 | A * | 8/1997 | Morrill | 251/1.3 |
| 6,192,680 | B1 | 2/2001 | Brugman et al. | |
| 6,202,753 | B1 | 3/2001 | Baugh | |
| 6,244,560 | B1 | 6/2001 | Johnson | |
| 7,318,480 | B2 | 1/2008 | Hosie et al. | |
| 7,424,917 | B2 | 9/2008 | Martin | |
| 2003/0037544 | A1 | 2/2003 | Armstrong | |
| 2009/0294129 | A1 * | 12/2009 | Judge et al. | 166/341 |

FOREIGN PATENT DOCUMENTS

| | | | |
|---|---|---|---|
| WO | 2006/048669 | A1 | 5/2006 |
| WO | 2006/068873 | A1 | 6/2006 |
| WO | 2008/096170 | A1 | 8/2008 |
| WO | 2009/035945 | A1 | 3/2009 |

OTHER PUBLICATIONS

European Search Report issued on Apr. 12, 2010 in corresponding European application No. EP09178142.
Partial EP Search Report issued in related EP Application No. 09 17 8143 and dated Apr. 20, 2012 (Some of the references cited in the Search Report were previously made of record in previous Information Disclosure Statements or Office Actions).

* cited by examiner

*Primary Examiner* — John Fristoe, Jr.
*Assistant Examiner* — Jessica Cahill
(74) *Attorney, Agent, or Firm* — Potomac Patent Group PLLC

(57) ABSTRACT

Method and device to be used for resetting a pressure in a low pressure recipient connected to a subsea pressure control device. The device includes the low pressure recipient configured to have first and second chambers separated by a first piston; a reset recipient configured to have third and fourth chambers separated by a piston assembly, and the piston assembly includes a second piston having first and second extension elements that extend along a direction of movement of the piston assembly. The third chamber has an inlet configured to allow the hydraulic liquid to enter the third chamber and an outlet configured to allow the hydraulic liquid to exit the third chamber, and the fourth chamber has an inlet configured to allow the hydraulic liquid to enter the fourth chamber and an outlet configured to allow the hydraulic liquid to exit the fourth chamber.

23 Claims, 14 Drawing Sheets

RECHARGEABLE SUBSEA FORCE GENERATING DEVICE AND METHOD

BACKGROUND

1. Technical Field

Embodiments of the subject matter disclosed herein generally relate to methods and devices and, more particularly, to mechanisms and techniques for recharging a device that generates a subsea force.

2. Discussion of the Background

During the past years, with the increase in price of fossil fuels, the interest in developing new production fields has dramatically increased. However, the availability of land-based production fields is limited. Thus, the industry has now extended drilling to offshore locations, which appear to hold a vast amount of fossil fuel.

The existing technologies for extracting the fossil fuel from offshore fields may use a system 10 as shown in FIG. 1. More specifically, the system 10 may include a vessel 12 having a reel 14 that supplies power/communication cords 16 to a controller 18. A MUX Reel may be used to transmit power and communication. Some systems have hose reels to transmit fluid under pressure or hard pipe (rigid conduit) to transmit the fluid under pressure or both. Other systems may have a hose with communication or lines (pilot) to supply and operate functions subsea. However, a common feature of these systems is their limited operation depth. The controller 18 is disposed undersea, close to or on the seabed 20. In this respect, it is noted that the elements shown in FIG. 1 are not drawn to scale and no dimensions should be inferred from FIG. 1.

FIG. 1 also shows a wellhead 22 of the subsea well 23 and a drill line 24 that enters the subsea well 23. At the end of the drill line 24 there is a drill (not shown). Various mechanisms, also not shown, are employed to rotate the drill line 24, and implicitly the drill, to extend the subsea well.

However, during normal drilling operation, unexpected events may occur that could damage the well and/or the equipment used for drilling. One such event is the uncontrolled flow of gas, oil or other well fluids from an underground formation into the well. Such event is sometimes referred to as a "kick" or a "blowout" and may occur when formation pressure exceeds the pressure of the column of drilling fluid. This event is unforeseeable and if no measures are taken to prevent it, the well and/or the associated equipment may be damaged.

Another event that may damage the well and/or the associated equipment is a hurricane or an earthquake. Both of these natural phenomena may damage the integrity of the well and the associated equipment. For example, due to the high winds produced by a hurricane at the surface of the sea, the vessel or the rig that powers the undersea equipment may start to drift, resulting in breaking the power/communication cords or other elements that connect the well to the vessel or rig. Other events that may damage the integrity of the well and/or associated equipment are possible as would be appreciated by those skilled in the art.

Thus, a pressure controlling device, for example, a blowout preventer (BOP), might be installed on top of the well to seal the well in case that one of the above events is threatening the integrity of the well. The BOP is conventionally implemented as a valve to prevent the release of pressure either in the annular space between the casing and the drill pipe or in the open hole (i.e., hole with no drill pipe) during drilling or completion operations. FIG. 1 shows BOPs 26 or 28 that are controlled by the controller 18, commonly known as a POD.

The blowout preventer controller 18 controls an accumulator 30 to close or open BOPs 26 and 28. More specifically, the controller 18 controls a system of valves for opening and closing the BOPs. Hydraulic fluid, which is used to open and close the valves, is commonly pressurized by equipment on the surface. The pressurized fluid is stored in accumulators on the surface and subsea to operate the BOPs. The fluid stored subsea in accumulators may also be used to autoshear and/or to support acoustic functions when the control of the well is lost. The accumulator 30 may include containers (canisters) that store the hydraulic fluid under pressure and provide the necessary pressure to open and close the BOPs. The pressure from the accumulator 30 is carried by pipe 32 to BOPs 26 and 28.

As understood by those of ordinary skill in the art, in deep-sea drilling, in order to overcome the high hydrostatic pressures generated by the seawater at the depth of operation of the BOPs, the accumulator 30 has to be initially charged to a pressure above the ambient subsea pressure. Typical accumulators are charged with nitrogen but as pre-charge pressures increase, the efficiency of nitrogen decreases which adds additional cost and weight because more accumulators are required subsea to perform the same operation on the surface. For example, a 60-liter (L) accumulator on the surface may have a useable volume of 24 L on the surface but at 3000 m of water depth the usable volume is less than 4 L. To provide that additional pressure deep undersea is expensive, the equipment for providing the high pressure is bulky, as the size of the canisters that are part of the accumulator 30 is large, and the range of operation of the BOPs is limited by the initial pressure difference between the charge pressure and the hydrostatic pressure at the depth of operation.

In this regard, FIG. 2 shows the accumulator 30 connected via valve 34 to a cylinder 36. The cylinder 36 may include a piston (not shown) that moves when a first pressure on one side of the piston is higher than a second pressure on the other side of the piston. The first pressure may be the hydrostatic pressure plus the pressure released by the accumulator 30 while the second pressure may be the hydrostatic pressure. Therefore, the use of pressured canisters to store high-pressure fluids to operate a BOP make the operation of the offshore rig expensive and require the manipulation of large parts.

Still with regard to FIG. 2, the valve 34 may be provided between the accumulator 30 and the cylinder 36 in order to control the timing for applying the supplemental pressure from the accumulator 30. The supplemental pressure may be generated by the accumulator 30, according to an exemplary embodiment, by providing, for example, 16 300-L bottles, each carrying nitrogen under pressure. FIG. 3 shows such a bottle 50 having a first chamber 52 that includes nitrogen under pressure and a second chamber 54, separated by a bladder or piston 56 from the first chamber 52. The second chamber 54 is connected to the pipe 32 and may include hydraulic fluid. When the controller 18 instructs the accumulator 30 to release its pressure, each bottle 50 uses the nitrogen pressure to move the bladder 56 towards the pipe 32 such that the supplemental pressure is provided via pipe 32 to the cylinder 36. The initial pre-charge of the nitrogen is high but as the gas expands its pressure drops. During the operation of a BOP the hydraulic fluid moves a piston on the BOP to close the rams to shear a pipe, casing or other equipment in the wellbore (the term pipe will be used to describe the equipment being sheared). In most cases the pipe in the wellbore is smaller than the bore of the BOP so the initial movement of the ram blocks will not contact the pipe. Once the ram blocks contact the pipe the nitrogen pre-charge in the stored accumulator bottles has expanded substantially so its internal pressure is reduced. This expansion and loss of pressure adversely effect the amount of force available to shear the pipe in the wellbore once the ram blocks finally make contact. Furthermore, the pipe generally collapses before it shears so when the pipe does finally shear the piston has traveled even further which reduces the amount of available pressure to shear the pipe. Once the supplemental pressure in bottle 50 is used, the bottle has to be raised to the surface to be recharged or may be connected via a pipe to the surface such that high pressure is pumped again in the bottle.

Accordingly, it would be desirable to provide systems and methods that avoid the afore-described problems and drawbacks.

SUMMARY

According to one exemplary embodiment, there is a reset module to be used for resetting a pressure in a low pressure recipient connected to a subsea pressure control device. The reset module includes the low pressure recipient configured to have first and second chambers separated by a first piston, the first chamber being configured to receive a hydraulic liquid at a high pressure and the second chamber being configured to include a gas at a low pressure, wherein the first chamber is further configured to have a port via which the hydraulic liquid enters and exits the first chamber, and wherein the second chamber is sealed such that no liquid enters or exits via a port; and a reset mechanism attached to the low pressure recipient and configured to reset the low pressure in the second chamber.

According to another exemplary embodiment, there is a method to reset a low pressure in a low pressure recipient that is part of a reset module, the low pressure recipient being connected to a subsea pressure control device for providing the low pressure. The method includes receiving a hydraulic liquid at a first high pressure in the low pressure recipient, the low pressure recipient being configured to have first and second chambers separated by a first piston, the first chamber being configured to receive the hydraulic liquid and the second chamber being configured to include a gas at a low pressure, wherein the first chamber is further configured to have a port via which the hydraulic liquid enters and exits the first chamber, and wherein the second chamber is sealed such that no hydraulic liquid enters or exits via a port; compressing the gas in the second chamber such that the first piston moves to expand the first chamber; receiving a second high pressure in a reset recipient, which is configured to have third and fourth chambers separated by a piston assembly, wherein the third chamber is separated by the second chamber of the low pressure recipient by a wall, and the second high pressure determines the piston assembly to move to expand the fourth chamber and to squeeze the third chamber; and moving the first piston, under a direct action of the piston assembly of the reset recipient, such that the second chamber is reestablished and the first chamber is squeezed.

According to still another exemplary embodiment, there is a method to reset a low pressure in a low pressure recipient that is part of a reset module, the low pressure recipient being connected to a subsea pressure control device for providing the low pressure. The method includes receiving a hydraulic liquid at a first high pressure in the low pressure recipient, the low pressure recipient being configured to have first and second chambers separated by a first piston, the first chamber being configured to receive the hydraulic liquid and the second chamber being configured to include a gas at the low pressure, wherein the first chamber is further configured to have a port via which the hydraulic liquid enters and exits the first chamber, and wherein the second chamber is sealed such that no hydraulic liquid enters or exits via a port; compressing the gas in the second chamber such that the first piston moves to expand the first chamber; applying a rotational motion to a screw drive that is configured to enter the second chamber for extending or retracting the screw drive to and from the second chamber; and moving the first piston, under a direct action of the screw drive, such that the second chamber is reestablished and the first chamber is squeezed.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of BOP systems. However, the embodiments to be discussed next are not limited to these systems, but may be applied to other systems that require the repeated supply of force when the ambient pressure is high such as in a subsea environment, as for example a subsea pressure control device. In addition, the embodiments to be discussed next may also be applied to other systems that require the repeated supply of force when the ambient pressure is high such as in a subsea environment, such as, but not limited to, a lower marine riser package (or LMRP) (19) or a lower blowout preventer stack. Also, non-limiting examples of subsea pressure control devices include a ram BOP or an annular BOP, as known in the art.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
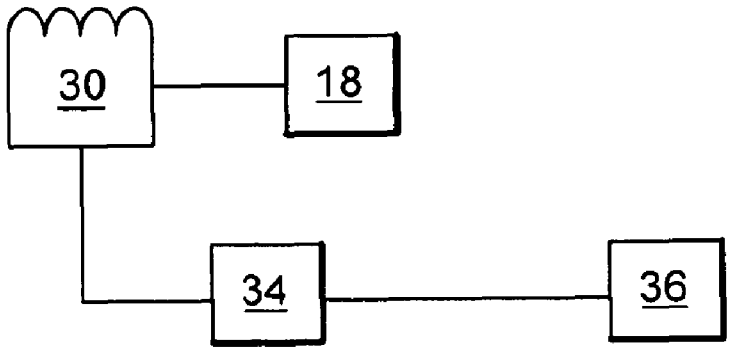
FIG. 2 Prior Art
FIG. 2 is a schematic diagram of an accumulator for generating the undersea force.
Figure 3:
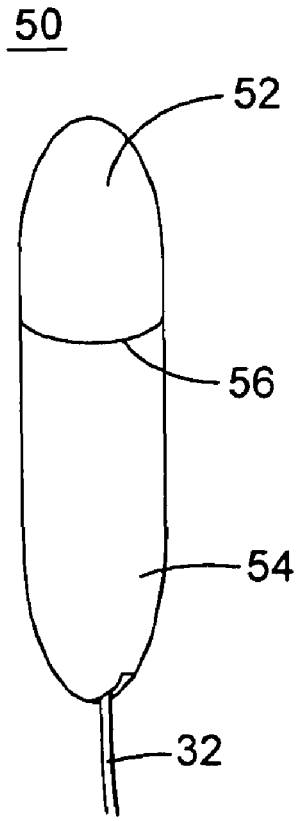
FIG. 3 Prior Art
FIG. 3 is a schematic diagram of a bottle of the accumulator of FIG. 2.

As discussed above with regard to FIG. 2, the accumulator 30 is bulky because of the low efficiency of nitrogen at high pressures. As the offshore fields are located deeper and deeper (in the sense that the distance from the sea surface to the seabed is becoming larger and larger), the nitrogen based accumulators become less efficient given the fact that the difference between the initial charge pressure to the local hydrostatic pressure decreases for a given initial charge of chamber 52, thus, requiring the size of the accumulators to increase (it is necessary to use 16 320-L bottles or more depending on the required shear pressure and water depth), and increasing the price to deploy and maintain the accumulators.

Figure 4:
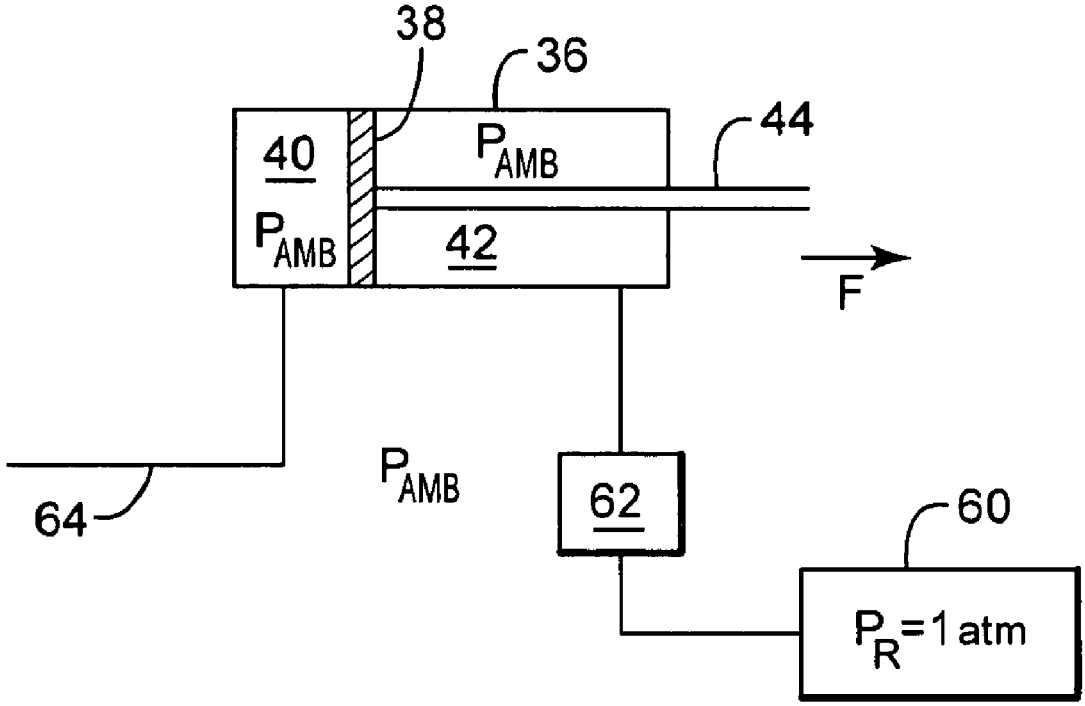
FIG. 4 is a schematic diagram of a low pressure recipient connected to a BOP.

As disclosed in U.S. patent application Ser. No. 12/338,652, filed concurrently with this application, commonly assigned, and entitled "Subsea Force Generating Device and Method" by R. Gustafson (hereinafter "Gustafson"), the entire disclosure of which is incorporated herein, a novel arrangement, as shown in FIG. 4, may be used to generate the force F. FIG. 4 shows an enclosure 36 that includes a piston 38 capable of moving inside the enclosure 36. The piston 38 divides the enclosure 36 into a chamber 40, defined by the cylinder 36 and the piston 38. Chamber 40 is called the closing chamber. Enclosure 36 also includes an opening chamber 42 as shown in FIG. 4.

The pressure in both chambers 40 and 42 may be the same, i.e., the sea pressure (ambient pressure). The ambient pressure in both chambers 40 and 42 may be achieved by allowing the sea water to freely enter these chambers via corresponding valves (not shown). Thus, as there is no pressure difference on either side of the piston 38, the piston 38 is at rest and no force F is generated.

When a force is necessary to be supplied for activating a piece of equipment, the rod 44 associated with the piston 38 has to be moved. This may be achieved by generating a pressure imbalance on two sides of the piston 38.

Although the arrangement shown in FIG. 4 and described in Gustafson discloses how to generate the undersea force without the use of the accumulators, however, as discussed later, the accumulators still may be used to supply a supplemental pressure. FIG. 4 shows that the opening chamber 42 may be connected to a low pressure recipient 60. A valve 62 may be inserted between the opening chamber 42 and the low pressure recipient 60 to control the pressures between the opening chamber 42 and the low pressure recipient 60.

The low pressure recipient 60 may have various shapes and may be made of steel, or any material that is capable of withstanding seawater pressures. However, the initial pressure inside the low pressure recipient is substantially 1 atm, when the recipient is at the sea level. After the recipient is lowered to the sea bed, the pressure inside the recipient may become higher as the sea level exerts a high pressure on the walls of the recipient, thus compressing the gas inside. Various gases may be used to fill the low pressure recipient 60. However, the pressure inside the recipient 60 is smaller than the ambient pressure $P_{amb}$, which is approximately 350 atm at a depth of 4000 m.

As shown in FIG. 4, when there is no need to supply the force, the pressure in both the closing and opening chambers is $P_{amb}$ while the pressure inside the recipient 60 is approximately $P_r$=1 atm or lower to improve efficiency. When a force is required for actuation of a piece of equipment of the rig, for example, a ram block of the BOP, valve 62 opens such that the opening chamber 42 may communicate with the low pressure recipient 60. The following pressure changes take place in the closing chamber 40, the opening chamber 42 and the low pressure recipient 60. The closing chamber 40 remains at the ambient pressure as more seawater enters via pipe 64 to the closing chamber 40 as the piston 38 starts moving from left to right in FIG. 4. The pressure in the opening chamber 42 decreases as the low pressure $P_r$ becomes available via the valve 62, i.e., seawater from the opening chamber 42 moves to the low pressure recipient 60 to equalize the pressures between the opening chamber 42 and the low pressure recipient 60. Thus, a pressure imbalance occurs between the closing chamber 40 and the opening chamber 42 and this pressure imbalance triggers the movement of the piston 38 to the right in FIG. 4, thus generating the force F.

Figure 5:
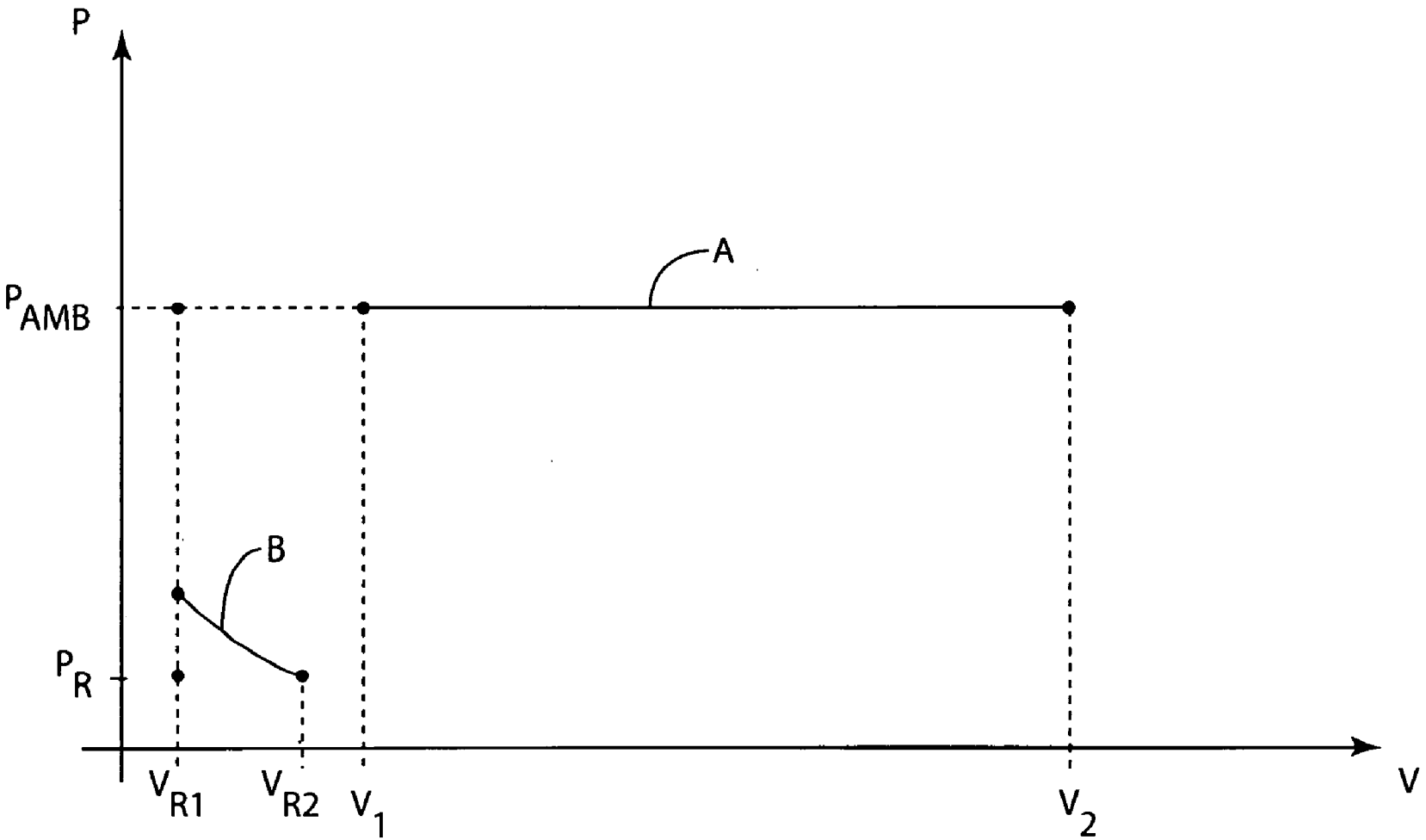
FIG. 5 is a graph showing a pressure inside the low pressure recipient and the BOP shown in FIG. 4.

FIG. 5 shows a graph of the pressure versus volume for the closing chamber 40 and the low pressure recipient 60. The pressure of the closing chamber 40 remains substantially constant (see curve A) while the volume of the closing chamber 40 expands from a small initial volume $V_1$, to a larger final volume $V_2$. The pressure in the low pressure recipient 60 slightly increases from approximately 1 atm ($P_R$) due to the liquid received from the opening chamber 42, as shown by curve B. The back pressure caused by this increase is small in comparison to the volume that can be displaced from the opening chamber 42. The volume of the low pressure recipient 60 should be sized to accept the volume being displaced.

Because of the large pressure difference between the two sides of piston 38, a large net force F may be achieved without using any canister charged with nitrogen at high pressure. Therefore, the system shown in FIG. 4 advantageously provides a reduced cost solution to generating a force as the low pressure recipient 60 is filed with, for example, air at sea level surface. In addition, the device for generating the force may have a small size as the size of the low pressure recipient 60 may be smaller compared to the existing accumulators 30. In one exemplary embodiment, the low pressure recipient 60 may be a stainless steel container having a 250 L volume compared to a nitrogen pre-charged system requiring 5000 L capacity (16 320-L bottles). Another advantage of the device shown in FIG. 4 is the possibility to easily retrofit the existing deep sea rigs with such a device.

Figure 6:
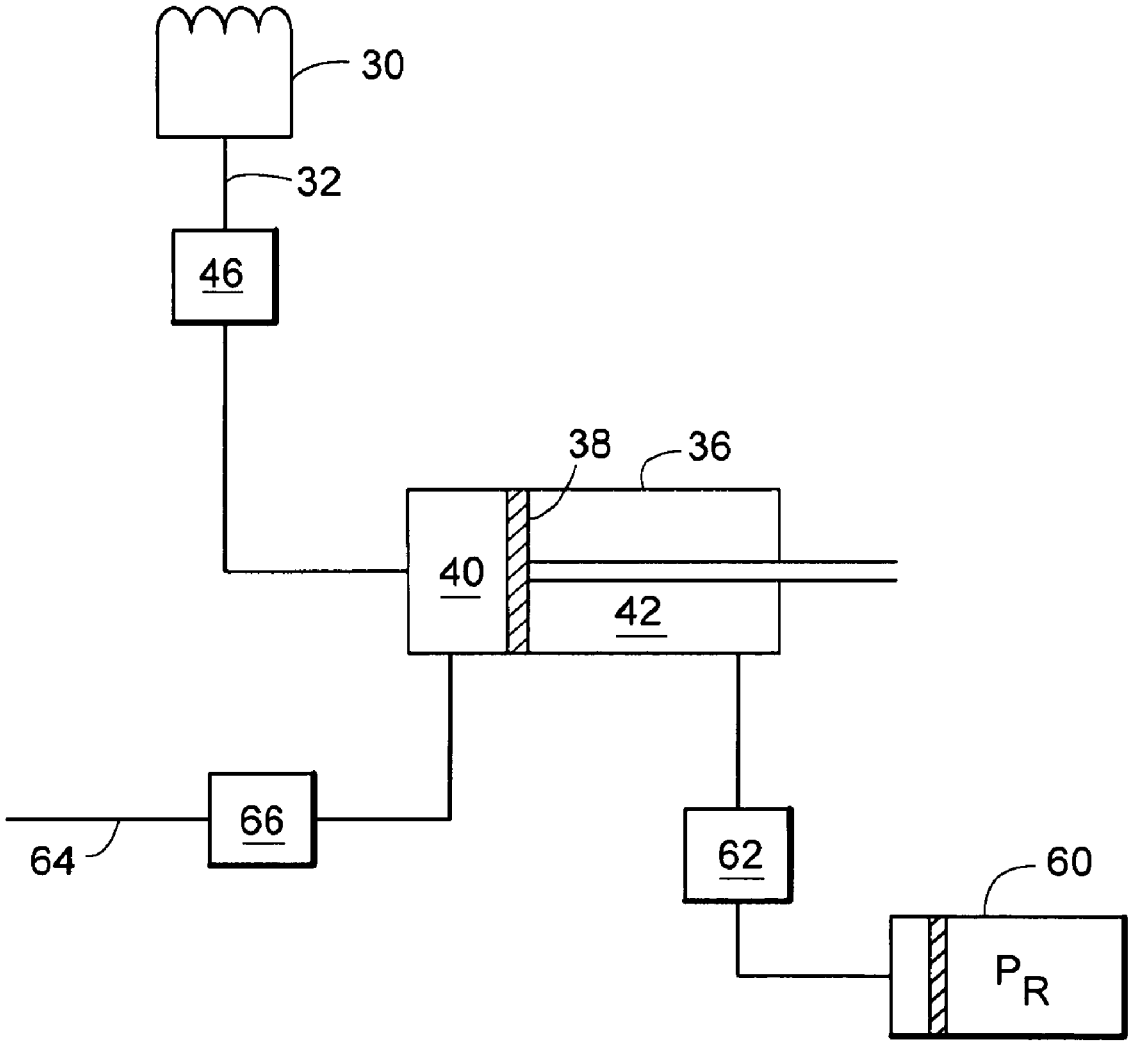
FIG. 6 is a schematic diagram of the low pressure recipient connected to the BOP of FIG. 4 to which an accumulator is added.

The low pressure recipient 60 may be used in conjunction with nitrogen based accumulators as shown in FIG. 6. The closing chamber 40 of the enclosure 36 is connected not only to the seawater via pipe 64 but also to the accumulator 30 that is capable of supplying the supplemental pressure. When appropriate conditions are reached, a valve 66 may close the sea water supply to the closing chamber 40 and a valve 46 may open to allow the supplemental pressure from the accumulator 30 to reach the closing chamber 40.

One feature of the devices shown in FIGS. 4 and 6 is the fact that the low pressure recipient 60 has a limited functionality. More specifically, once the seawater from the opening chamber 42 was released into the low pressure recipient 60, the low pressure recipient 60 cannot again supply the low pressure unless a mechanism is implemented to empty the low pressure recipient 60. In other words, the seawater at the ambient pressure that occupies the low pressure recipient 60 after valve 62 has been opened, has to be removed and the gas at the atmospheric pressure that existed in the low pressure recipient 60 prior to opening the valve 62 has to be reestablished for recharging the low pressure recipient 60.

Figure 7:
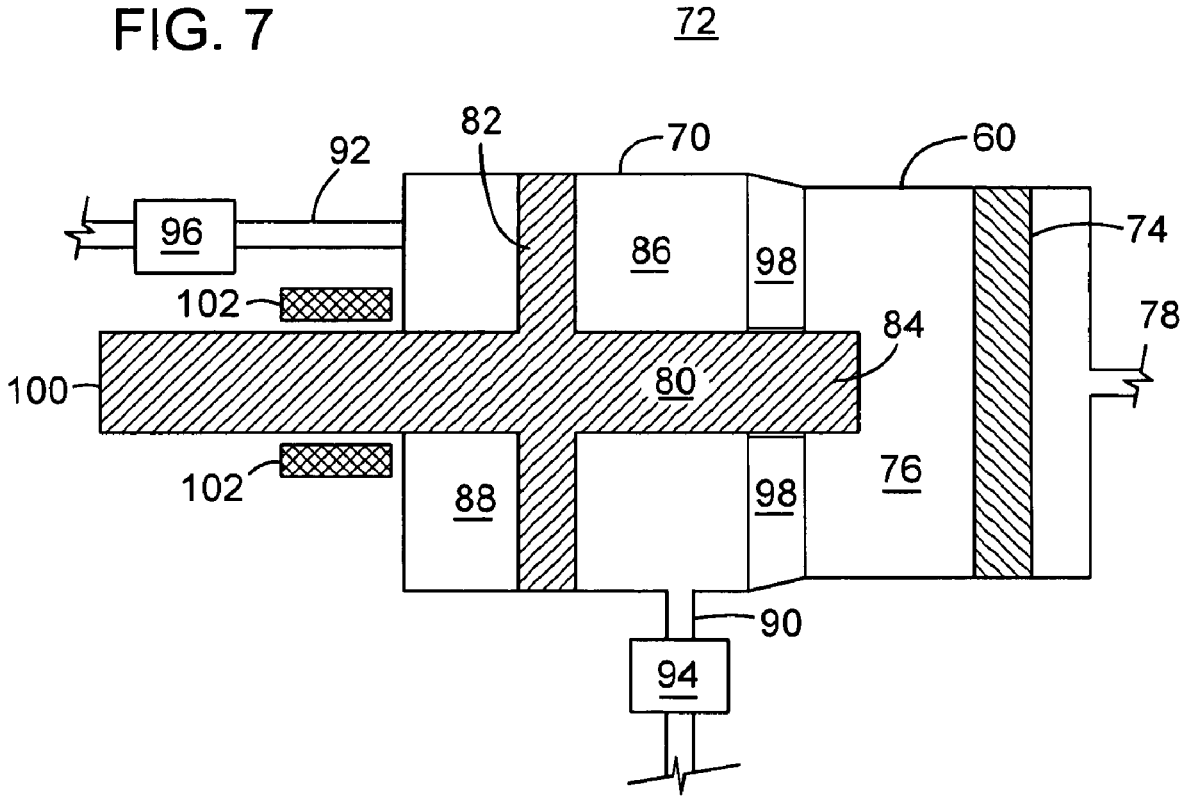
FIG. 7 is a schematic diagram of a low pressure recipient having a reset recipient according to an exemplary embodiment.

According to an exemplary embodiment and as shown in FIG. 7, the low pressure recipient 60 may be reused by providing a reset recipient 70 connected to the low pressure recipient 60. The reset recipient 70 and the low pressure recipient 60 may be formed integrally, i.e., in one piece. FIG. 7 shows the low pressure recipient 60 and the reset recipient 70 formed in a single reset module 72.

The low pressure recipient 60 may include a movable piston 74 that defines a low pressure gas chamber 76. This low pressure gas (or vacuum) chamber 76 is the chamber that is filed with gas (air for example) at atmospheric pressure and provides the low pressure to the opening chamber 42 of the BOP. The low pressure recipient 60 may include a port 78, which may be a hydraulic return port to the BOP. The connection of the port 78 to the BOP is discussed later.

A piston assembly 80 penetrates into the low pressure recipient 60. The piston assembly 80 is provided in the reset recipient 70. The piston assembly 80 includes a piston 82 and a first extension element 84. The piston 82 is configured to move inside the reset recipient 70 while the first extension element 84 is configured to enter the low pressure recipient 60 to apply a force to the piston 74. The piston 82 divides the reset recipient 70 into a reset opening retract chamber 86 and a reset closing extend chamber 88. The reset opening retract chamber 86 is configured to communicate via a port 90 with a pressure source (not shown). The reset closing extend chamber 88 is configured to communicate via a port 92 to the pressure source or another pressure source. The release of the pressure from the pressure source to the reset recipient 70 may be controlled by valves 94 and 96. A solid wall 98 may be formed between the low pressure recipient 60 and the reset recipient 70 to separate the two recipients. A second extension element 100 of the piston 82 may be used to lock the piston 82. The piston 82 may be locked in a desired position by a locking mechanism 102. Mechanisms for locking a piston are know in the art, for example, Hydril Multiple Position Locking (MPL) clutch, from Hydril Company LP, Houston, Tex. or other locking device such as a collet locking device or a ball grip locking device. Other mechanisms can be employed to hold the position of the piston but this is not meant to limit the device but only to state different ways to maintain its desired position.

Figure 8A:
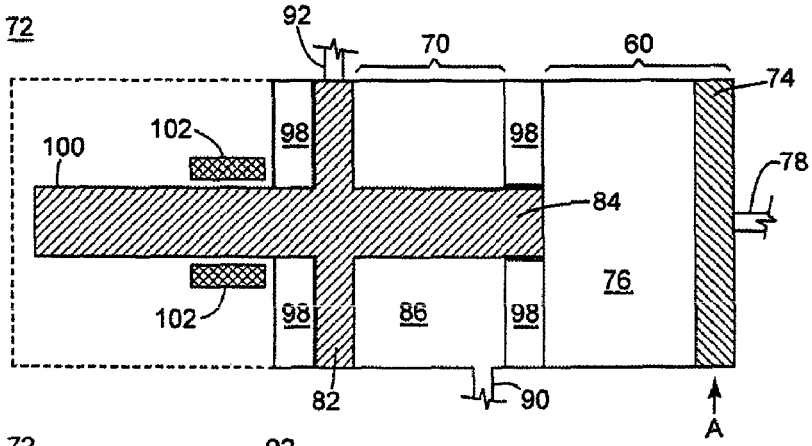
FIGS. 8A-F are schematic diagrams of the low pressure recipient with the reset recipient showing the various positions of their pistons according to an exemplary embodiment.

An operation of the reset module 72 is discussed with reference to an exemplary embodiment illustrated in FIGS. 8A-F. According to this exemplary embodiment, the reset module 72 is ready to supply the atmospheric pressure to the BOP when configured as shown in FIG. 8A. FIG. 8A shows the piston 74 contacting a side of the low pressure recipient 60 such that the low pressure gas chamber 76 has a substantially maximum volume. The pressure of the gas in chamber 76 may be much less than the ambient pressure (water pressure at that depth). The piston 82 is positioned in the reset recipient 70 such that the reset opening retract chamber 86 is fully extended and the reset closing extend chamber 88 is fully compressed. The piston assembly 80 is kept in place in the position shown in FIG. 8A by the locking mechanism 102, which locks the second extension element 100.

Figure 1:
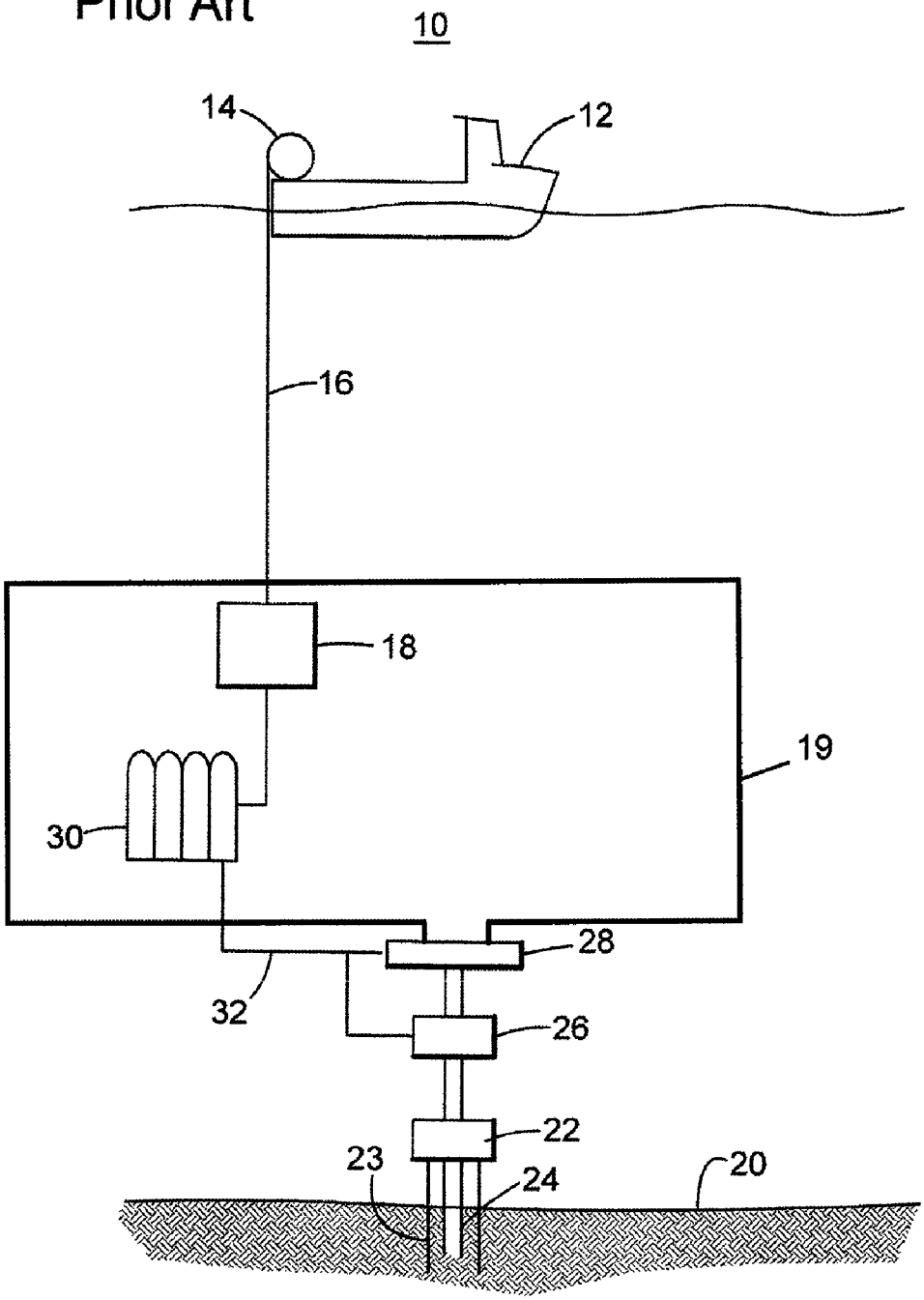
FIG. 1 Prior Art
FIG. 1 is a schematic diagram of a conventional offshore rig.
Figure 8B:
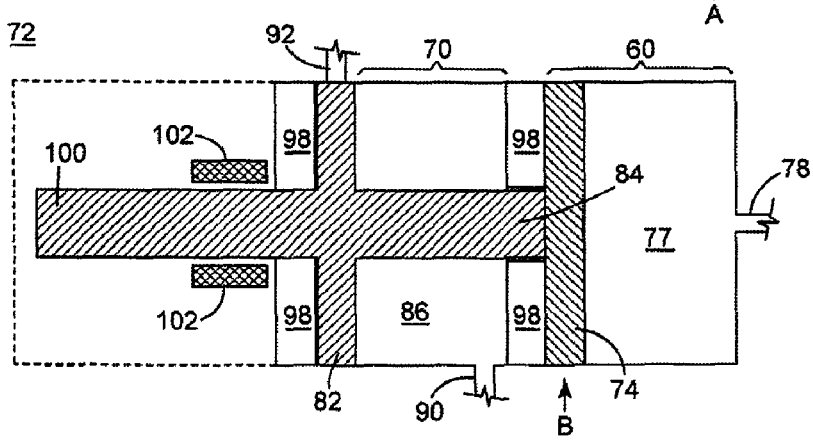
Figure 9:
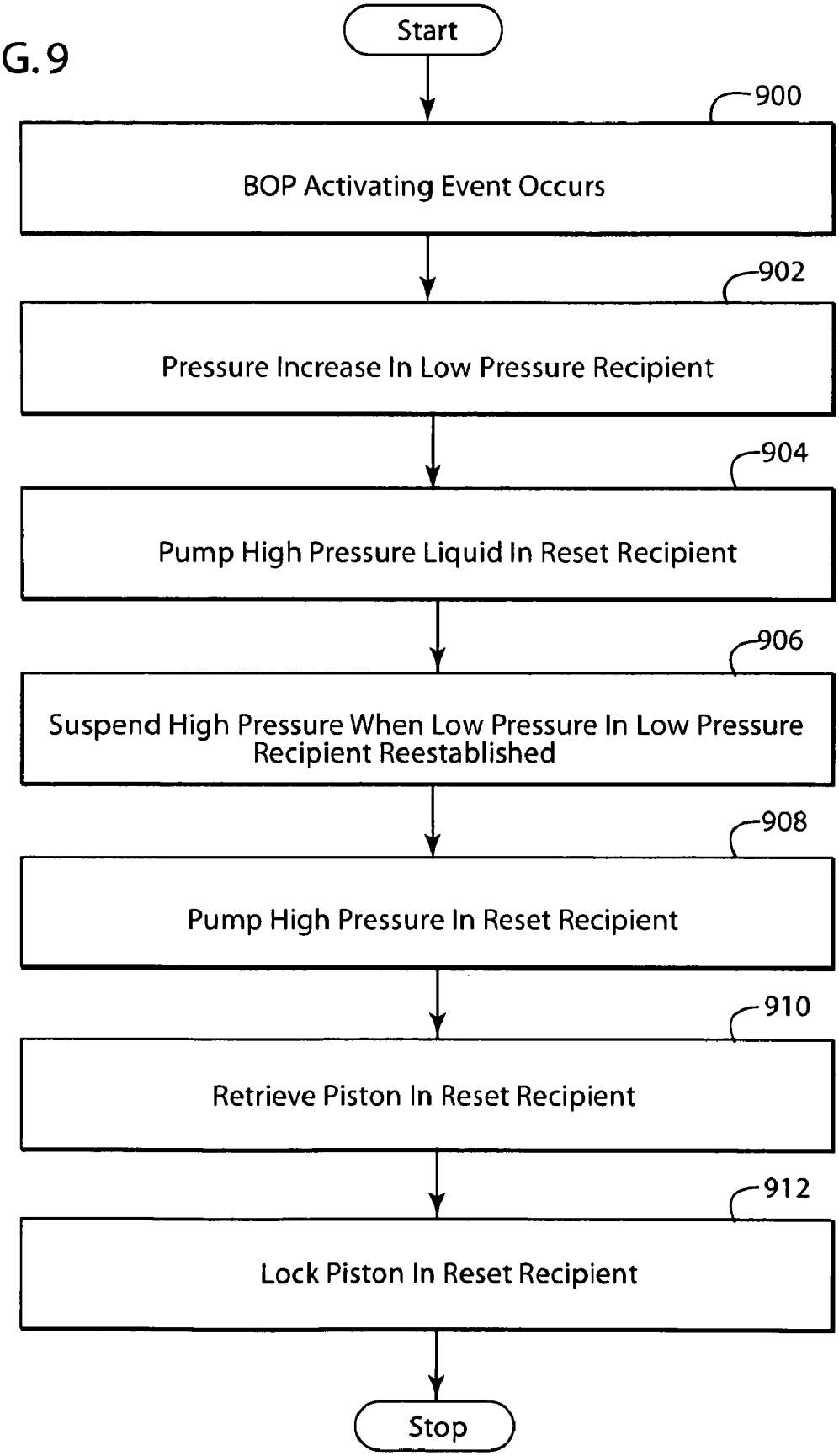
FIG. 9 is a flow chart illustrating steps for operating the low pressure recipient and the reset recipient according to an exemplary embodiment.

When the BOP is triggered by a certain event to enter into action, as shown in step 900 in FIG. 9, the controller 18 (see FIG. 1) may instruct the valve 62 (see FIG. 6) to open such that the high pressure from the BOP enters the low pressure recipient 60 via port 78. This corresponds to step 902 in FIG. 9. The reset module 72 is configured at this time as shown in FIG. 8B, i.e., the piston 74 has compressed the low pressure gas in chamber 76 such that chamber 76 is substantially non-existent. This is due to the large difference in pressure between the chamber 76 in FIG. 8A and the ambient pressure (sea pressure) entering via port 78. Also, in the configuration shown in FIG. 8B, the newly formed chamber 77 is filled with the liquid that entered via port 78 at the high (ambient) pressure. This liquid may be sea water or an appropriate hydraulic liquid.

In order to reuse the low pressure recipient 60, i.e., to have again chamber 76 with the gas at low pressure, the piston 74 has to be moved from position B back to position A and the chamber 76 has to be reestablished. To achieve this result, a high pressure liquid may be inserted via port 92, between the walls 98 of the reset module 72 and the piston 82. The liquid inserted via port 92 has to have a pressure higher than the pressure in chamber 77, such that piston 82 is capable to move piston 74 from position B to position A. The high pressure liquid provided via port 92 may come from one or more accumulators, from surface via a pipe, etc. This process is illustrated as step 904 in FIG. 9. The high pressure liquid may be a hydraulic liquid. The hydraulic liquid may be a dedicated liquid that is used in the art, as would be recognized by one skilled in the art, or saltwater.

Figure 8C:
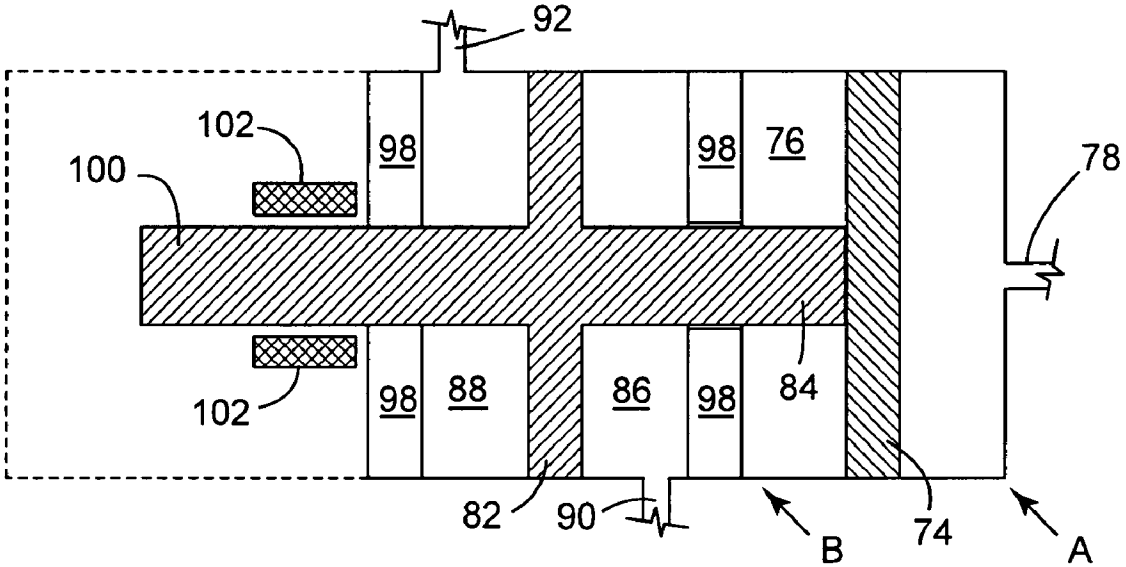
Figure 8D:
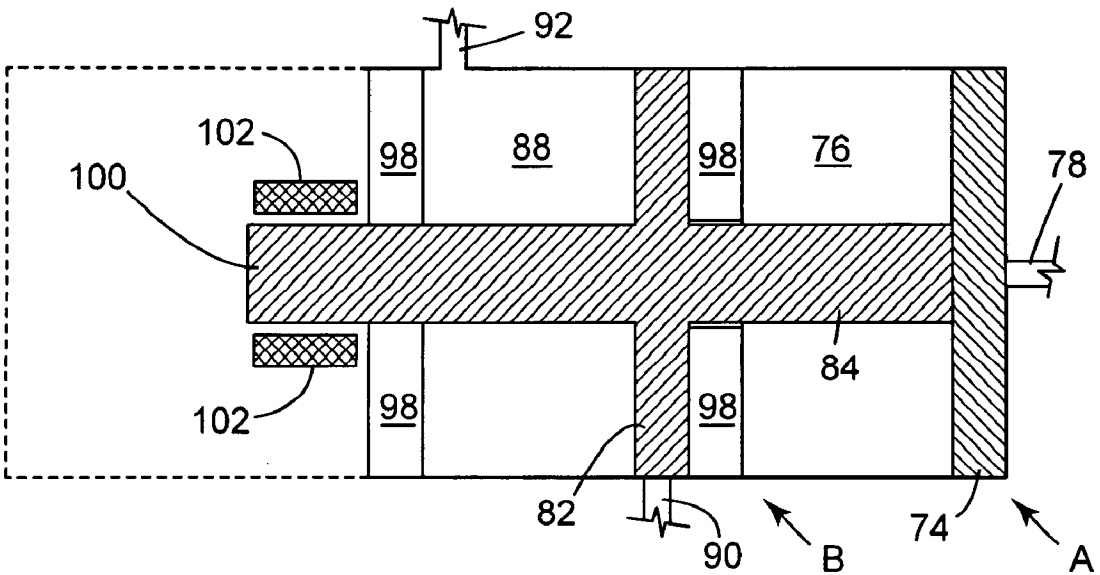

As the liquid is entering the reset recipient 70, more specifically the reset closing extend chamber 88, piston 82 is moving towards the low pressure recipient 60 pushing the piston 74 from B towards A, as shown in FIG. 8C. This process may continue until the piston 74 is close to the original position A and the chamber 76 has been reestablished with the low pressure as shown in FIG. 8D. At this point the reset closing extend chamber 88 has substantially a maximum volume and the reset opening retract chamber 86 has substantially a minimum volume. At this stage, the pressure applied to the liquid entering port 92 is suppressed such that piston 82 is not moving. This process corresponds to step 906 in FIG. 9. Not shown is the original supply valve connected to the opening port of the BOP operator that supplied pressure to port 78 and a vent valve that allows fluid to exhaust from chamber 77 when the cylinder is being reset. During the reset operation the supply valve may be blocked and a vent valve opened to allow the fluid volume at chamber 77 to exhaust to sea. Several methods of venting the trapped pressure exist and it is not the intent of this disclosure to list all the methods that are know to someone skilled in the art.

Figure 8E:
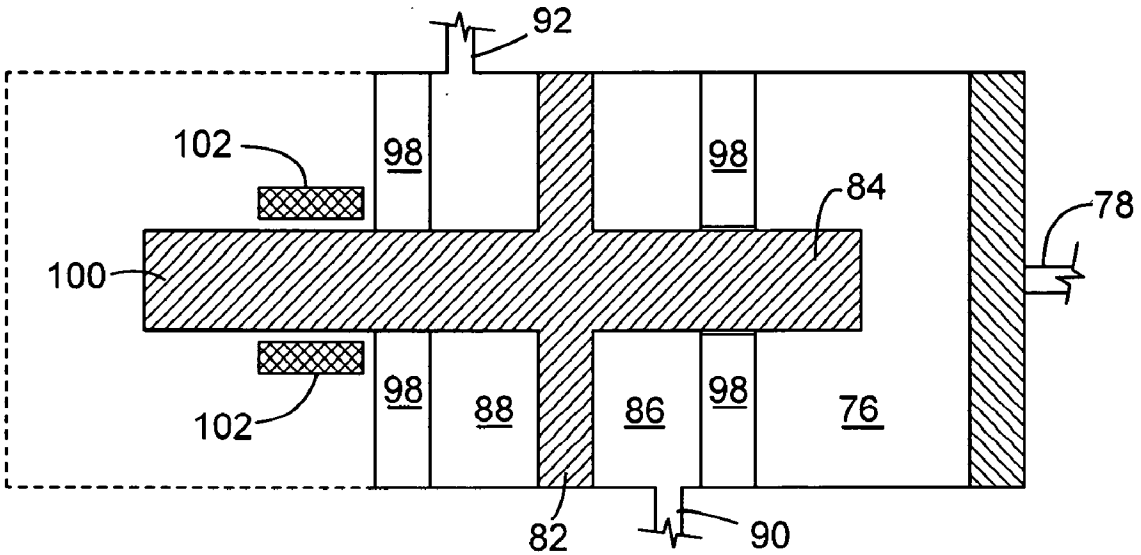
Figure 8F:
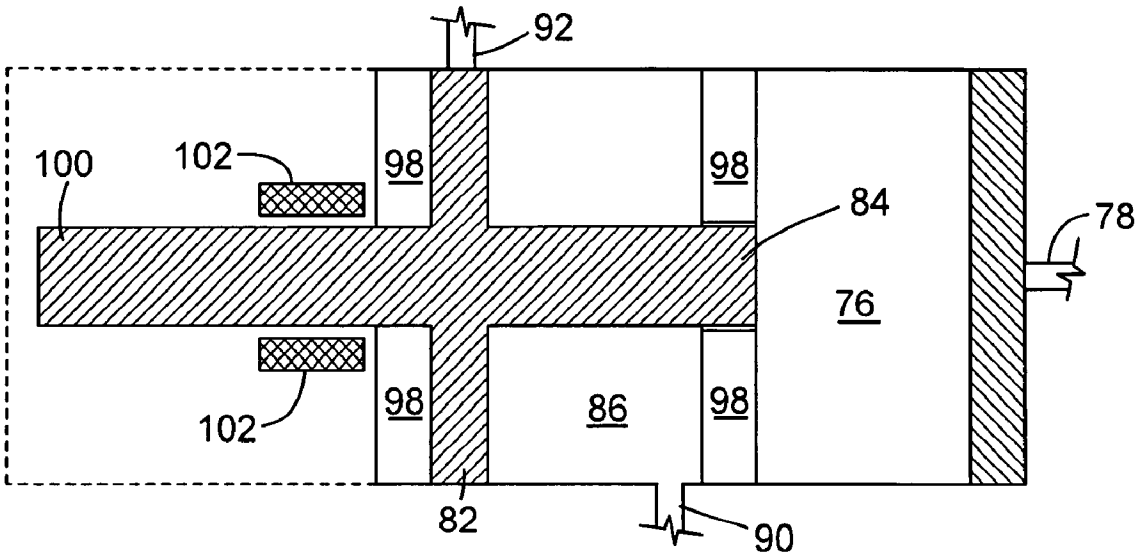

However, the configuration of the reset module 72 shown in FIG. 8D may be modified for more efficiently reusing the low pressure recipient 60 as the first extension element 84 of the piston assembly 80 is in a position that blocks a further movement of piston 74 from position A to position B. This configuration may be achieved if piston 82 is moved back to the position shown in FIG. 8A. To achieve this configuration, a high pressure liquid may be pumped via port 90 into the reset opening retract chamber 86, see step 908 in FIG. 9. When this process is taking place, the liquid present in the reset closing extend chamber 88 is evacuated (as will be discussed later) such that chamber 88 shrinks and chamber 86 fully expands, as shown in FIG. 8E. In FIG. 8E the piston assembly 80 is retrieved to its original position shown in FIG. 8A while in FIG. 8C the piston assembly 80 is pressed against piston 74 for resetting the piston 74 to its original position and for reestablishing the low pressure in chamber 76. This process may be performed until the piston assembly 80 is back at the original position, as shown in FIG. 8F. This step 910 is shown in FIG. 9. A further step 912, shown in FIG. 9, accounts for locking the second extension element 100 of the piston assembly 80 when the piston 82 is retrieved to its original position or close to its original position.

Figure 10:
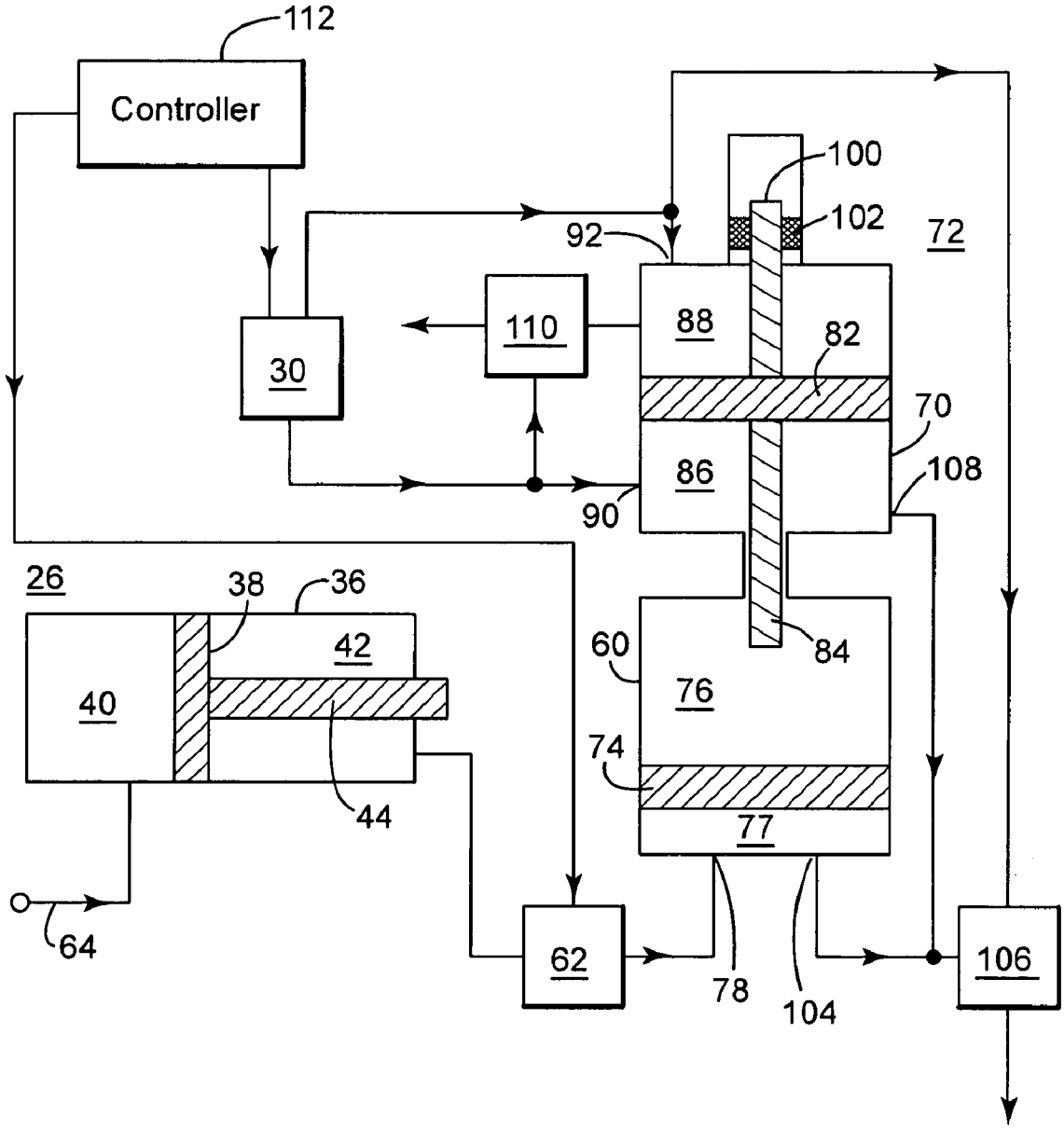
FIG. 10 is a schematic diagram of a system that includes the BOP, the low pressure recipient, and the reset recipient according to an exemplary embodiment.

With the reset module 72 configured as shown in FIG. 8F, the BOP may again use the low pressure from the low pressure recipient 60 to close and/or open the ram blocks. According to an exemplary embodiment, FIG. 10 shows part of the BOP 26, the reset module 72 and the accumulator 30 and connections among these elements. One of ordinary skill in the art would appreciate that the arrangement shown in FIG. 10 is one of many possible arrangements of the BOP 26, the reset module 72 and the accumulator 30, as many variations may be achieved, for example, by adding or removing valves between the shown connections. The exemplary configuration shown in FIG. 10 serves to better understand the functioning of the rechargeable force generation device (reset module 72).

FIG. 10 shows the BOP 26 as having the cylinder 36 connected to the low pressure recipient 60 and the low pressure recipient 60 having an additional port 104 connected to a valve 106. In another exemplary embodiment, ports 78 and 104 may be the same port. The reset recipient 70 is connected to the accumulator 30 via the ports 90 and 92. Each of these ports 90 and 92 may be connected to a corresponding accumulator. The reset recipient 70 may have a port 108 connecting chamber 86 to valve 106. This connection may serve to discharge the liquid pumped via port 90 in chamber 86 when the piston assembly 80 has to be retrieved to its original position.

The valve 106 may be activated by liquid pumped by the accumulator 30 when the same liquid is pumped into chamber 88. By activating (opening) the valve 106 when the accumulator 30 discharges the liquid into chamber 88, at least two functions are performed. First, the liquid from chamber 86 is allowed to exit chamber 86 such that chamber 86 may shrink and the liquid from chamber 77 is allowed to exit, via the same valve 106. The expelled liquid from chambers 86 and 77 may be reused (i.e., returned to accumulator 30) or discharged in the ambient. After the liquid from chambers 86 and 77 have been expelled, valve 106 closes and the liquid may be pumped, by accumulator 30, into chamber 86 to move the piston assembly 80 to its original position. When the liquid is pumped via port 90 into chamber 86, valve 110 is activated such that the liquid in chamber 88 is allowed to exit via valve 110. When the piston assembly 80 is back to its position shown in FIG. 8A, the locking mechanism 102 locks the piston assembly 80 such that piston 74 may move if the liquid from chamber 42 of cylinder 36 is allowed to expand into chamber 77 of the low pressure recipient 60. The process described above may be repeated multiple times and thus the low pressure recipient 60 may be reused.

According to an exemplary embodiment, the first extension element 84 of the piston assembly 80 is configured to press the piston 74 such that a volume of the chamber 77 is substantially zero when a volume of the chamber 86 is substantially zero. In addition, or independently, the second extension element 100 of the piston assembly 80 is configured to exit the chamber 88 such that a volume of the chamber 88 is substantially zero when a volume of the chamber 76 is substantially zero. According to another exemplary embodiment, the high pressure of the hydraulic liquid is between 200 and 400 atm above the ambient pressure and the pressure in chamber 76 of the low pressure recipient 60 is between 0.5 and 10 atm.

According to an exemplary embodiment, at least a pressure sensor may be provided in chamber 76 of the low pressure recipient 60 to monitor the low pressure in this chamber. Further, according to another exemplary embodiment, position detection sensors as described in U.S. Provisional Patent Application Ser. No. 61/138,005, filed on Dec. 16, 2008, to R. Judge et al., the entire disclosure of which is incorporated herein by reference, may be provided (i) in cylinder 36 to detect the position of piston 38, (ii) in the low pressure recipient 60 to detect the position of piston 74, and/or (iii) or in the reset recipient 70 to detect the position of piston 82. Knowing some or all of the positions of the pistons 38, 74, and/or 82, may allow a controller 112 to control the release of high pressure from accumulator 30 to one of ports 90 and 92 and also to control valve 62 between the BOP 26 and low pressure recipient 60.

Figure 11:
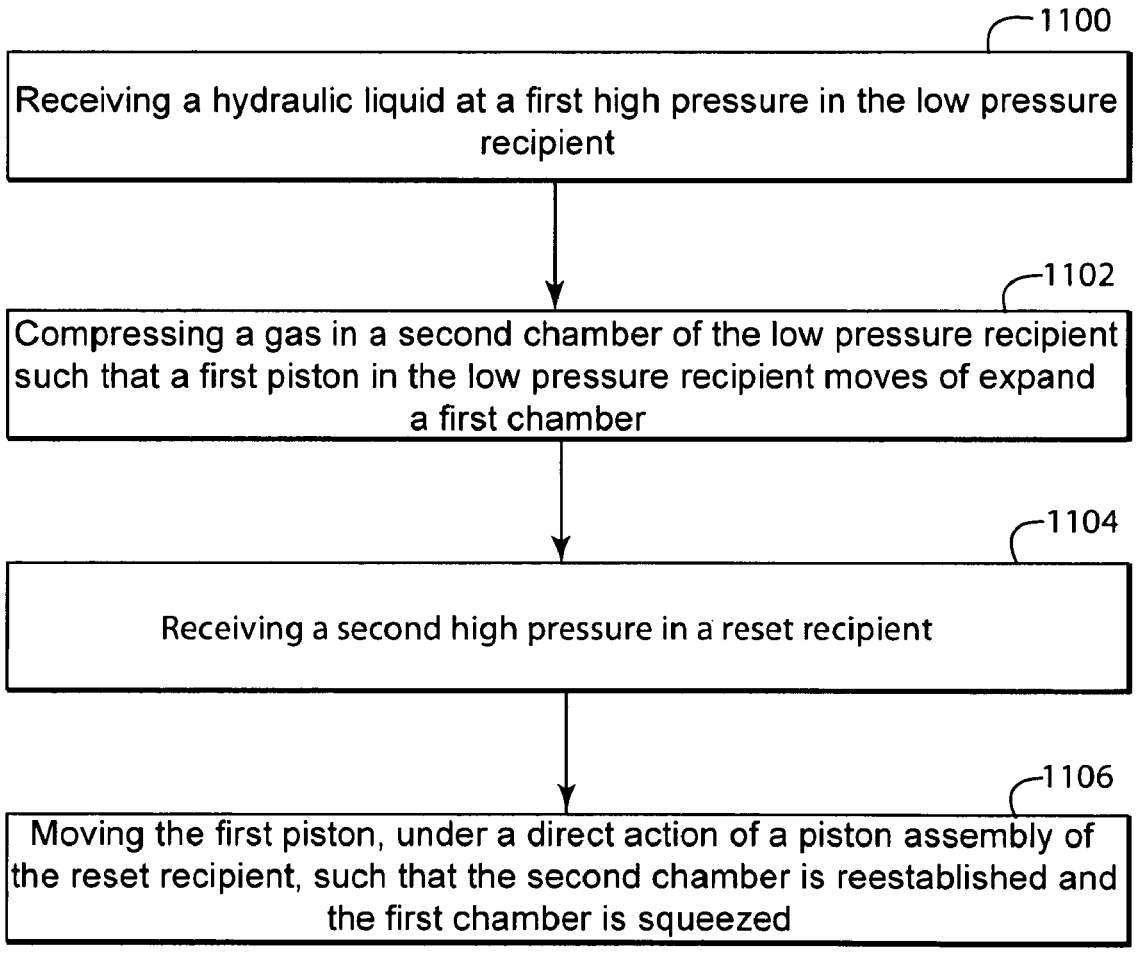
FIG. 11 is a flow chart illustrating steps for operating the low pressure recipient and the reset recipient according to an exemplary embodiment.

According to an exemplary embodiment, the steps of a method to recharge a low pressure recipient that is part of a reset module are illustrated in FIG. 11. The method includes a step 1100 of receiving a hydraulic liquid at a first high pressure in the low pressure recipient, the low pressure recipient being configured to have first and second chambers separated by a first piston, the first chamber being configured to receive the hydraulic liquid and the second chamber being configured to include a gas at a low pressure, wherein the first chamber is further configured to have an inlet via which the hydraulic liquid enters the first chamber and an outlet via which the hydraulic liquid exits the first chamber, and wherein the second chamber is sealed such that no hydraulic liquid enters or exits via a port, a step 1102 of compressing the gas in the second chamber such that the first piston moves to expand the first chamber, a step 1104 of receiving a second high pressure in a reset recipient, which is configured to have third and fourth chambers separated by a piston assembly, wherein the third chamber is separated by the second chamber of the low pressure recipient by a wall, and the second high pressure determines the piston assembly to move to expand the fourth chamber and to squeeze the third chamber, and a step 1106 of moving the first piston, under a direct action of the piston assembly of the reset recipient, such that the second chamber is reestablished and the first chamber is squeezed.

Figure 12:
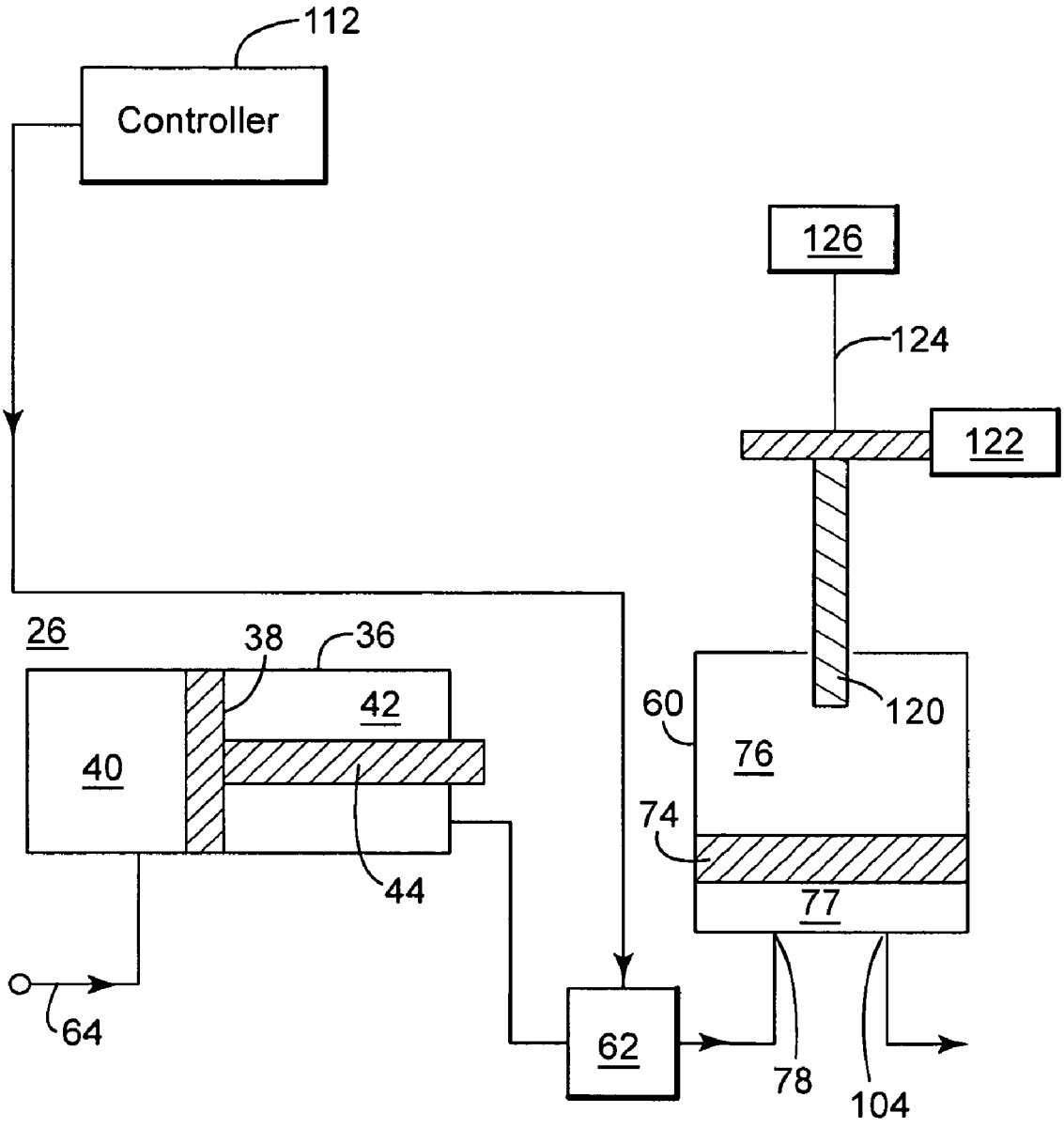
FIG. 12 is a schematic diagram of a system that includes the BOP, the low pressure recipient and a reset mechanism according to an exemplary embodiment.

According to another exemplary embodiment, the low pressure recipient may be reset not by the reset recipient 70 shown in FIG. 7 but by a reset mechanism as shown in FIG. 12. Considering that chambers 76 and 77 are separated by sealed piston 74, a mechanical screw drive 120 is provided to enter chamber 76 and to press on piston 74 if necessary. Thus, when chamber 77 is substantially at maximum and chamber 76 is substantially nonexistent, the screw drive 120 may be activated to press the piston 74 to reestablish chamber 76. Those skilled in the art would appreciate that other mechanical mechanisms may be used to move piston 74 to reestablish chamber 76.

The screw drive 120 may be operated by a remote operated vehicle 122 (ROV), a diver, a subsea torque tool or other mode. In addition, the screw drive 120 may be operated by an electric drive source such as a motor to reset the piston. Alternatively, a motor (not shown) may be placed on the low pressure chamber 60 and connected to the screw drive 120 for reestablishing chamber 76. The motor may be, in one application, an electric motor and the power for the motor may be supplied via a cable 124 from a power source 126.

Figure 13:
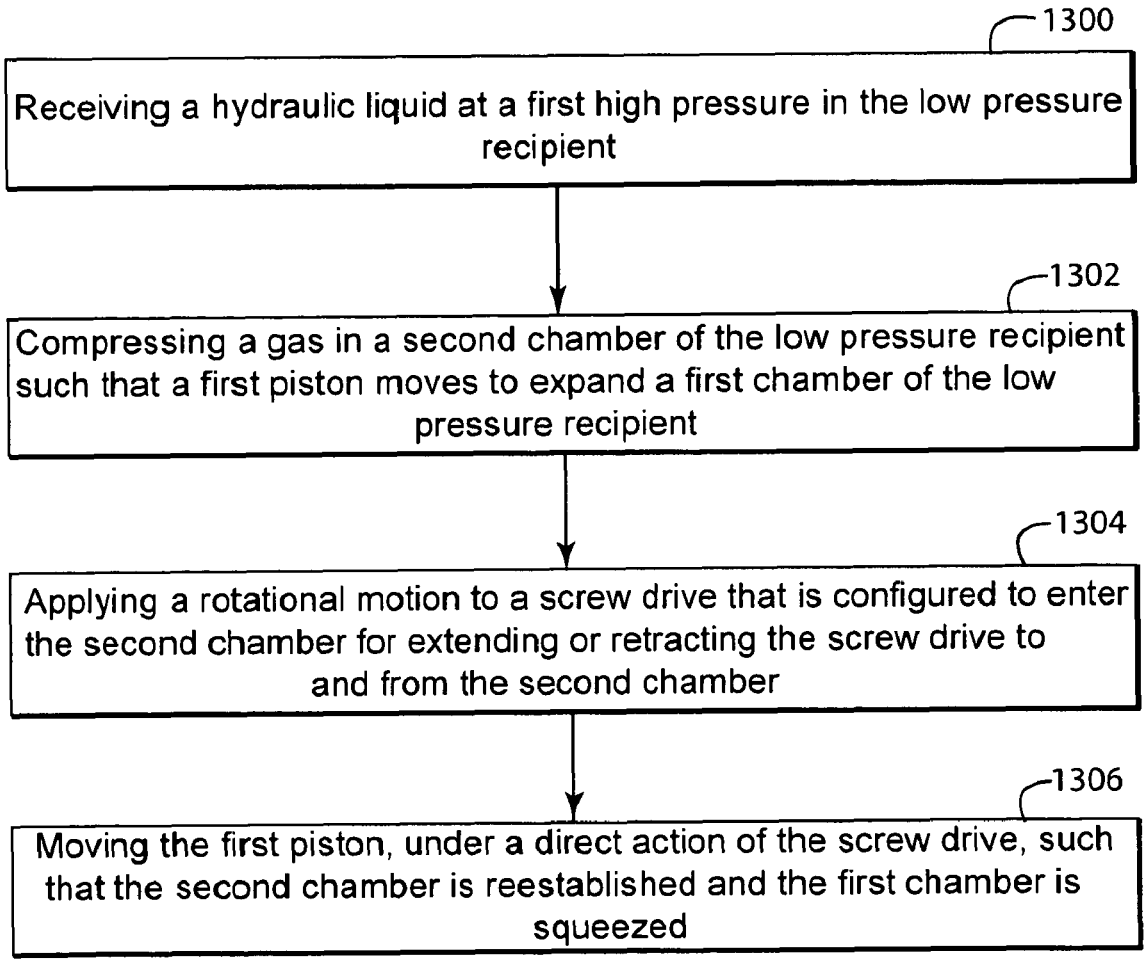
FIG. 13 is a flow chart illustrating steps for operating the low pressure recipient and the reset mechanism according to an exemplary embodiment.

According to an exemplary embodiment, FIG. 13 illustrates steps of a method for resetting a low pressure in a low pressure recipient that is part of a reset module, the low pressure recipient being connected to a subsea pressure control device for providing the low pressure. The method includes a step 1300 of receiving a hydraulic liquid at a first high pressure in the low pressure recipient, the low pressure recipient being configured to have first and second chambers separated by a first piston, the first chamber being configured to receive the hydraulic liquid and the second chamber being configured to include a gas at the low pressure, wherein the first chamber is further configured to have a port via which the hydraulic liquid enters and exits the first chamber, and wherein the second chamber is sealed such that no hydraulic liquid enters or exits via a port, a step 1302 of compressing the gas in the second chamber such that the first piston moves to expand the first chamber, a step 1304 of applying a rotational motion to a screw drive that is configured to enter the second chamber for extending or retracting the screw drive to and from the second chamber, and a step 1306 of moving the first piston, under a direct action of the screw drive, such that the second chamber is reestablished and the first chamber is squeezed.

The disclosed exemplary embodiments provide a device and a method for repeatedly generating an undersea force with a reduced consumption of energy and at a low cost. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements with insubstantial differences from the literal languages of the claims.

What is claimed is:

1. A reset module to be used for resetting a pressure in a low pressure recipient connected to a subsea pressure control device, the reset module comprising:

the low pressure recipient configured to have first and second chambers separated by a first piston, the first chamber being configured to receive a hydraulic liquid at a high pressure and the second chamber being configured to include a gas at a low pressure, wherein the first chamber is further configured to have a port via which the hydraulic liquid enters and exits the first chamber, and the second chamber is sealed such that no liquid enters or exits via a port; and a reset mechanism attached to the low pressure recipient and configured to reset the low pressure in the second chamber by actuating a first extension element to contact and displace the first piston along a given direction, wherein the first extension element is configured to move along an opposite direction independent of the first piston.

2. The reset module of claim 1, wherein the high pressure is between 200 and 400 atm above an ambient pressure and the low pressure in the low pressure recipient is between 0.5 and 10 atm.

3. The reset module of claim 1, wherein the reset mechanism comprises:

a screw drive entering the second chamber and configured to be extendable into and retractable from the second chamber to displace the first piston towards and from the first chamber.

4. A lower marine riser package comprising the reset module of claim 1.

5. A blowout preventer stack comprising the reset module of claim 1.

6. The reset module of claim 1, wherein the subsea pressure control device is a ram blowout preventer.

7. The reset module of claim 1, wherein the subsea pressure control device is an annular blowout preventer.

8. The reset module of claim 1, wherein the reset mechanism comprises:

a reset recipient configured to have third and fourth chambers , wherein the third chamber is separated from the second chamber of the low pressure recipient by a sealed wall; and a piston assembly separating the third chamber from the fourth chamber and including a second piston having the first extension element and a second extension element, both the first and second extension elements extending along a direction of movement of the piston assembly, the first extension element being configured to enter the second chamber of the low pressure recipient and contact the first piston and the second extension element being configured to extend out of the fourth chamber of the reset recipient, wherein the third chamber has an inlet configured to allow the hydraulic liquid to enter the third chamber and an outlet configured to allow the hydraulic liquid to exit the third chamber, and the fourth chamber has an inlet configured to allow the hydraulic liquid to enter the fourth chamber and an outlet configured to allow the hydraulic liquid to exit the fourth chamber.

9. The reset module of claim 8, further comprising:

a first valve connected to the port of the first chamber and to the outlet of the third chamber; and a second valve connected to the outlet of the fourth chamber, wherein the first valve is configured to be activated when the hydraulic liquid is pumped into the fourth chamber, and the second valve is configured to be activated when the hydraulic liquid is pumped into the third chamber.

10. The reset module of claim 8, further comprising:

a locking mechanism provided in a fifth chamber or fourth chamber and configured to lock the second extension element of the piston assembly.

11. The reset module of claim 8, wherein the first extension element of the piston assembly is configured to press the first piston such that a volume of the first chamber is substantially zero when a volume of the third chamber is substantially zero.

12. The reset module of claim 8, wherein the second extension element of the piston assembly is configured to exit the fourth chamber such that a volume of the fourth chamber is substantially zero when a volume of the second chamber is substantially zero.

13. The reset module of claim 8, further comprising:

an accumulator connected to the third and fourth chambers and configured to provide the hydraulic liquid at high pressure.

14. A method to reset a low pressure in a low pressure recipient that is part of a reset module, the low pressure recipient being connected to a subsea pressure control device for providing the low pressure, the method comprising:

receiving a hydraulic liquid at a first high pressure in the low pressure recipient, the low pressure recipient being configured to have first and second chambers separated by a first piston, the first chamber being configured to receive the hydraulic liquid and the second chamber being configured to include a gas at a low pressure, wherein the first chamber is further configured to have a port via which the hydraulic liquid enters and exits the first chamber, and wherein the second chamber is sealed such that no hydraulic liquid enters or exits via a port;

compressing the gas in the second chamber such that the first piston moves to expand the first chamber;

receiving a second high pressure in a reset recipient, which is configured to have third and fourth chambers separated by a piston assembly, wherein the third chamber is separated by the second chamber of the low pressure recipient by a wall, and the second high pressure makes the piston assembly to move to expand the fourth chamber and to squeeze the third chamber; and moving the first piston along a given direction, under a direct action of a first extension element of the piston assembly of the reset recipient, such that the second chamber is reestablished and the first chamber is squeezed, wherein the first extension element is configured to move along an opposite direction independent of the first piston.

15. The method of claim 14, wherein the second high pressure is between 200 and 400 atm above an ambient pressure and the low pressure in the low pressure recipient is between 0.5 and 10 atm.

16. The method of claim 14, wherein the step of receiving a second high pressure further comprises:

providing the second high pressure in the fourth chamber.

17. The method of claim 16, further comprising:

providing the second high pressure in the third chamber such that the piston assembly moves to expand the third chamber and squeeze the fourth chamber, wherein the piston assembly includes a second piston having the first extension element and a second extension element, the first and second extension elements extending along a direction of movement of the piston assembly, the first extension element being configured to enter the second chamber of the low pressure recipient and contact the first piston and the second extension element being configured to extend out of the fourth chamber of the reset recipient.

18. The method of claim 17, further comprising:

locking the second extension element of the piston assembly with a locking mechanism provided in a fifth chamber when the second piston has moved to expand the third chamber to have a maximum volume.

19. The method of claim 17, further comprising:

displacing the first extension element of the piston assembly to directly press the first piston such that a volume of the first chamber is substantially zero when a volume of the third chamber is substantially zero.

20. The method of claim 17, further comprising:

displacing the second extension element of the piston assembly to exit the fourth chamber such that a volume of the fourth chamber is substantially zero when a volume of the second chamber is substantially zero.

21. The method of claim 17, further comprising:

activating a first valve by pumping the hydraulic liquid into the fourth chamber, wherein the first valve is connected to an outlet of the first chamber and to an outlet of the third chamber.

22. The method of claim 21, further comprising:

activating a second valve when the hydraulic liquid is pumped into the third chamber, wherein the second valve is connected to an outlet of the fourth chamber.

23. The method of claim 22, further comprising:

activating the first and second valves based on a control unit such that the piston assembly changes the volumes of the third and fourth chambers.

* * * * *